United States Patent [19]

Barsk

[11] Patent Number: 4,608,216

[45] Date of Patent: Aug. 26, 1986

[54] METHOD FOR THE CASTING OF HOLLOW SLABS OUT OF CONCRETE

[75] Inventor: Jaakko O. Barsk, Tampere, Finland

[73] Assignee: Oy Partek Ab, Toijala, Finland

[21] Appl. No.: 607,135

[22] Filed: May 4, 1984

[30] Foreign Application Priority Data

May 9, 1983 [FI] Finland ..... 831606

[51] Int. Cl.[4] ..... B28B 1/08; B28B 21/08

[52] U.S. Cl. ..... 264/70; 264/33; 264/72; 264/209.2; 264/209.3; 264/177 R; 264/312; 264/333; 425/63; 425/426; 425/427

[58] Field of Search ..... 264/33, 72, 312, 70, 264/209.2, 209.3, 177 R, 333; 425/426, 427, 425, 262, 63, 64, 219

[56] References Cited

U.S. PATENT DOCUMENTS

| | | | |
|---|---|---|---|
| 2,892,218 | 6/1959 | McGhee et al. | 425/426 |
| 3,159,897 | 12/1964 | Ellis et al. | 425/427 |
| 3,877,860 | 4/1975 | Putti | 425/64 |
| 4,022,556 | 5/1977 | Goetjen | 425/219 |
| 4,046,848 | 9/1977 | Putti | 264/70 |

*Primary Examiner*—Jan Silbaugh
*Assistant Examiner*—Hubert C. Lorin
*Attorney, Agent, or Firm*—Burns, Doane, Swecker & Mathis

[57] ABSTRACT

Method for the casting of hollow slabs out of concrete by slide-casting. Concrete mix is extruded onto a base (18) preferably by means of a conical screw spiral (2). Thereinafter the mix is compacted by moving a cavity mandrel (3) fitted after the screw sprial. The end of the cavity mandrel (3) is moved along a path of movement of desired shape. The final end of the mandrel may be attached to the machine by means of a ball joint.

9 Claims, 13 Drawing Figures

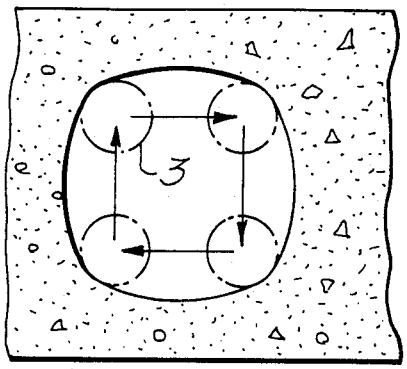
Fig. 7a.
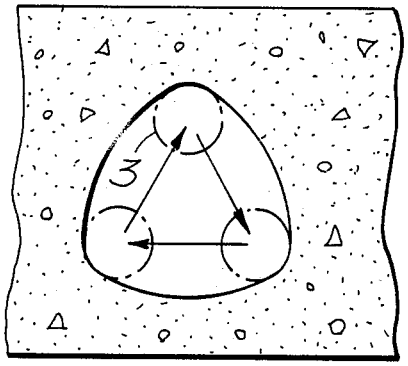
Fig. 7b.
Fig. 7c
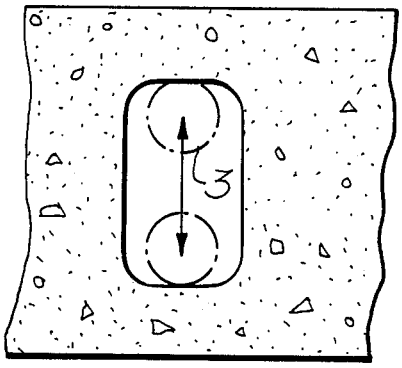
Fig. 7d.
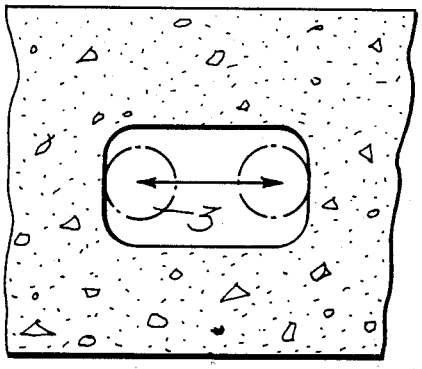

METHOD FOR THE CASTING OF HOLLOW SLABS OUT OF CONCRETE

BACKGROUND AND SUMMARY OF THE INVENTION

The present invention is concerned with a method for the casting of hollow slabs out of concrete by slide-casting, whereat concrete mix is extruded onto a base by using one or several forming members forming the cavities and the mix is compacted by moving the forming member. The invention is also concerned with a slide-casting machine for casting hollow slabs out of concrete, which device comprises a deck plate, side walls, one or several feeder members for feeding the concrete mix, as well as one or several movable forming members for forming the cavities. The invention is in particular suitable for the production of prestressed hollow slabs. It may also be applied to the manufacture of hollow slabs of reinforced concrete.

Several slide-casting machines for hollow slabs are known in prior art, which are of a similar principle as compared with each other and in which the concrete mix is extruded in the machine by means of spiral screws. The machine runs along rails placed on the base. The spiral screw is of conical shape with the cone expanding towards the final end, whereby an efficient compacting of the concrete is also achieved.

Immediately as an extension of the spiral screw, there is a shaping member, i.e. a so-called cavity mandrel, which is vibrated by means of a vibrator fitted inside the mandrel. Moreover, a vibrator beam fitted in the deck portion of the machine is vibrated, whereat the vibration of the cavity mandrels together with the surface vibration at the top of the machine produces an ultimate compacting of the concrete.

The cavity mandrel is followed by a so-called follower tube, whose function is to support the cavity wall at the final end of the machine.

Drawbacks of the cavity mandrel are the strong noise (higher than 85 dBA) resulting from the high vibration frequency, the high power requirement, and the low efficiency of the vibration power used for the vibration.

By means of the present invention, the prior-art cavity vibration is replaced by using a compacting process suitable for compacting a soil-moist concrete mix.

The method in accordance with the present invention is characterized in that one end or both ends of the forming member are moved along a path of movement of desired shape. Most appropriately, one point of the longitudinal axis of the forming member maintains its position relative its support member. The slide-casting machine in accordance with the invention is characterized in that one end or both ends of the forming member can be moved along a path of movement of desired shape. The forming member may be attached to its support shaft by means of a universal-joint fastening.

In front of each forming member, there may be a screw spiral as the feeder member. Most appropriately, at least the initial end of the mandrel is moved. Within the path of movement of the initial end of the cavity mandrel, the stroke length of the mandrel is a few millimeters. At the same time, the mandrel may additionally either revolve around its longitudinal axis, or it may not revolve. The path of movement of the end of the mandrel may be of circular shape, but it may also be of some other shape, e.g. square.

When a mandrel revolving around its longitudinal axis is used, usually, cavities of circular section are produced in the hollow slabs. When the mandrel does not revolve around its longitudinal axis, the cross-sectional form of the mandrel may also be different from circular. In this way, the cavities can be shaped as desired. Even when a revolving mandrel is used, according to the present invention, it is possible to produce cavities of a sectional form different from circular if the path of movement of the end of the mandrel is not circular.

Advantages of the method in accordance with the invention include:

essentially lower noise level as compared with cavity vibrators whose vibration frequency is 150 to 250 Hz.

Owing to the wide path of movement of the end of the mandrel next to the spiral screw, the compacting process of the concrete can be shifted from the area of the screws to the area of the mandrel.

BRIEF DESCRIPTION OF THE DRAWINGS

These and other objects and advantages of the invention will be described in more detail in the following description when read in conjunction with the attached drawings, wherein FIGS. 7*a* to 7*d* show different paths of movement of the cavity mandrel.

DETAILED DESCRIPTION OF THE PREFERRED EMBODIMENTS

Figure 1:
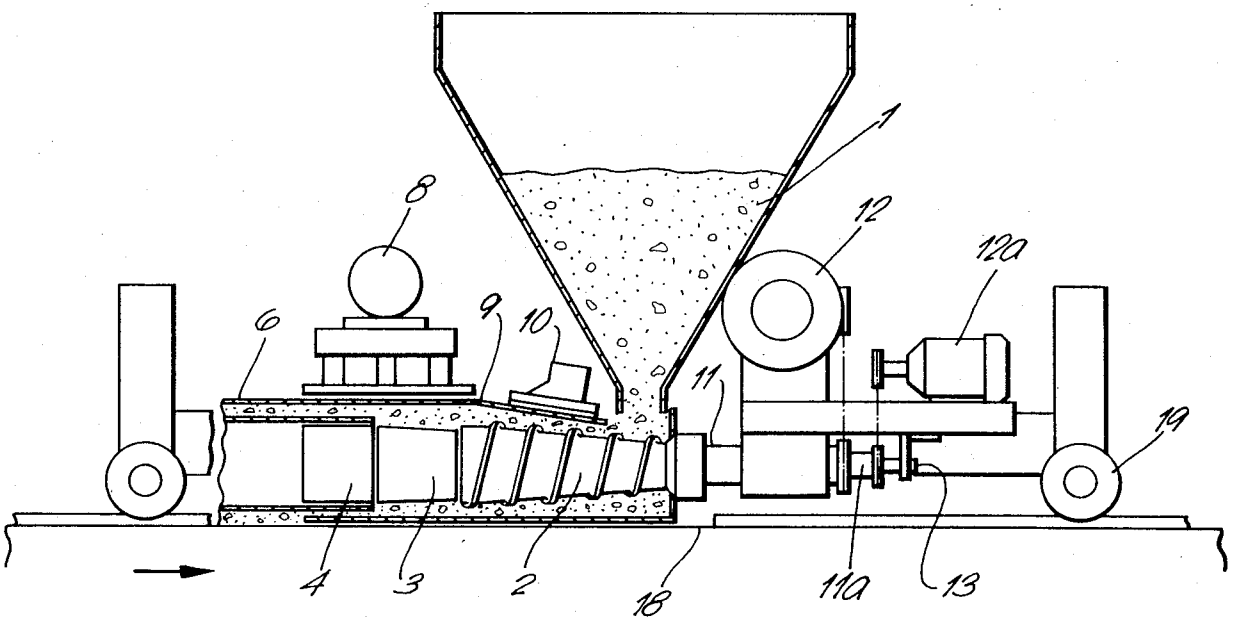
FIG. 1 is a longitudinal sectional view of a slide-casting machine in accordance with the invention.
Figure 2:
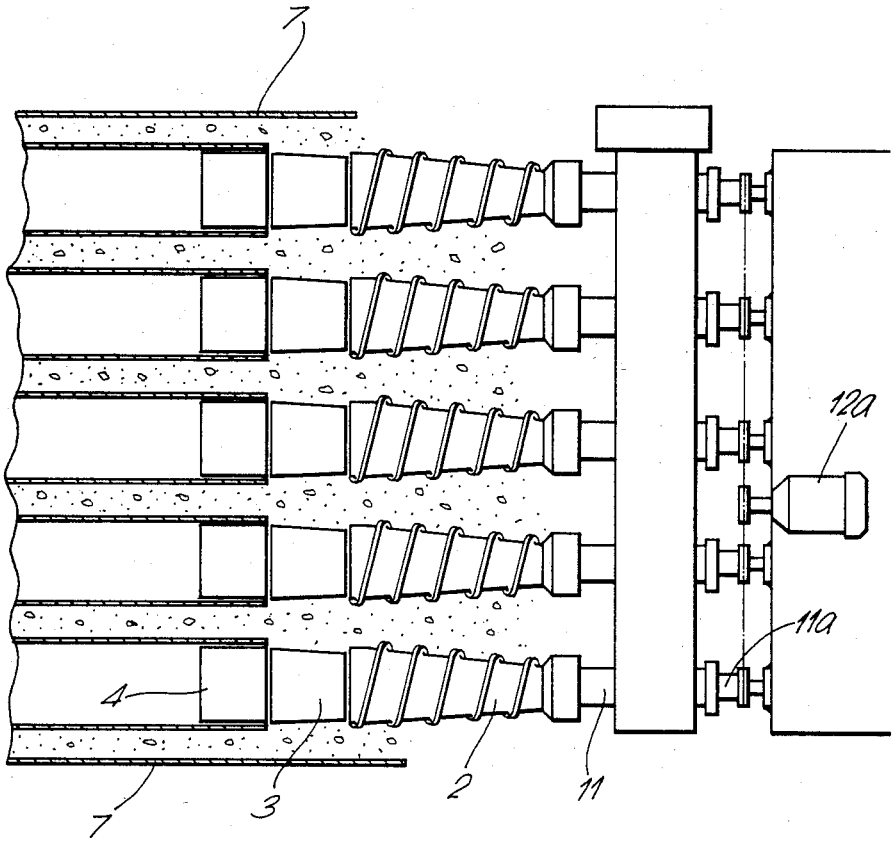
FIG. 2 shows the same machine as viewed from above and as a section.

The feeding funnel 1 is connected to the initial end of the slide-casting machine. Depending on the size of the slab to be cast, the machine comprises 3 to 8 spiral screws 2, which are in such a way conical that they expand towards the final end of the machine. After the spiral screw 2, a cavity mandrel 3 is fitted, which is followed by a follower tube 4. The device additionally comprises a deck plane 6 and side boards 7. A vibrator 8 is fitted above the deck plane 6. The position of the initial end 9 of the deck plane can be adjusted by means of a front rib 10.

Each screw 2 is attached to a shaft 11, which is driven by means of a motor 12. The shaft 11*a* extends through the screw up to the initial end of the cavity mandrel 3, and it is driven by the motor 12*a*. The machine moves on the base 18 as supported on wheels 19 in the direction indicated by an arrow.

Figure 3:
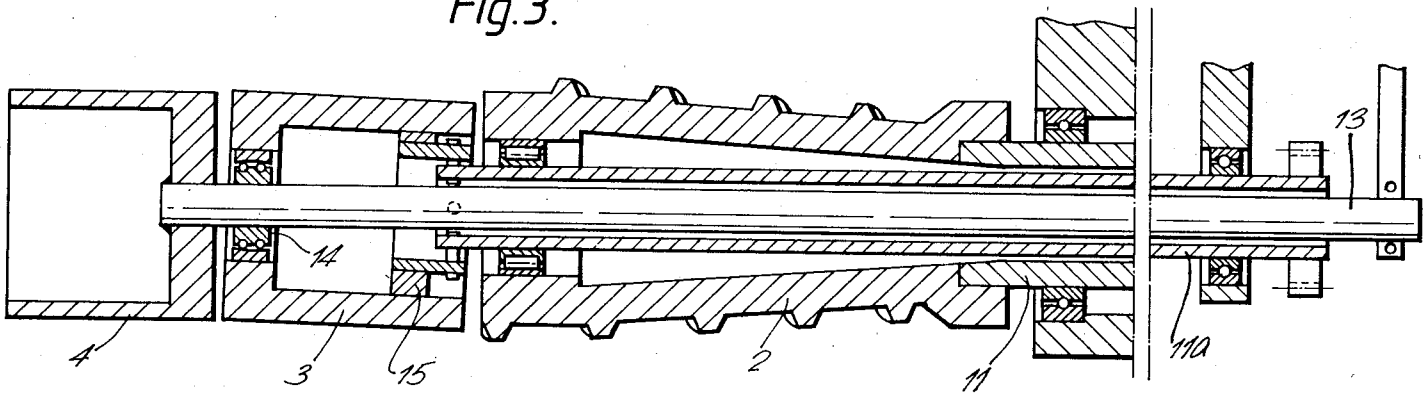
FIG. 3 is an enlarged view of a detail of one embodiment, whereat the cavity mandrel revolves around its axis.
Figure 4:
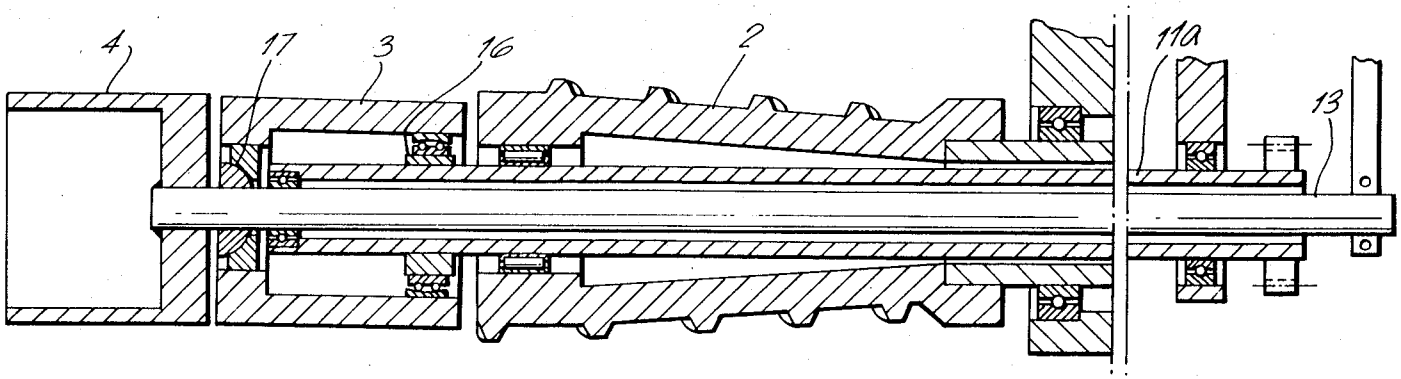
FIG. 4 shows a detail of a second embodiment, whereat the cavity mandrel does not revolve around its axis.

In the embodiment shown in FIG. 3, the cavity mandrel 3 revolves on the support shaft 13 passing through the drive shaft 11*a* of the mandrel. The fastening 15 of the initial end of the cavity mandrel on the shaft 11*a* is eccentric, whereat the mandrel moves as supported on a bearing joint 14 while the shaft 11*a* revolves. Thereby the initial end of the centre axis of the mandrel 3 moves along a circular path around the centre axis of the screw spiral 2. The face on which the initial end moves is a spherical face whose centre point is the joint 14. The shape of the cavity mandrel may be a cone widening towards the final end, in which case the cavity formed by the cavity mandrel is of circular cross-section.

In the embodiment in accordance with FIG. 1, the initial end of the cavity mandrel 3 is journalled on the drive shaft 11*a* by means of an eccentric bearing 16 and its final end is attached to the shaft 13 by means of a ball joint 17. The mandrel 3 does not revolve around its own axis. When the shaft 11*a* revolves, the eccentric journalling 16 causes that now the initial end of the centre axis of the mandrel 3 also moves along a circular path around the centre axis of the screw spiral.

Figure 5:
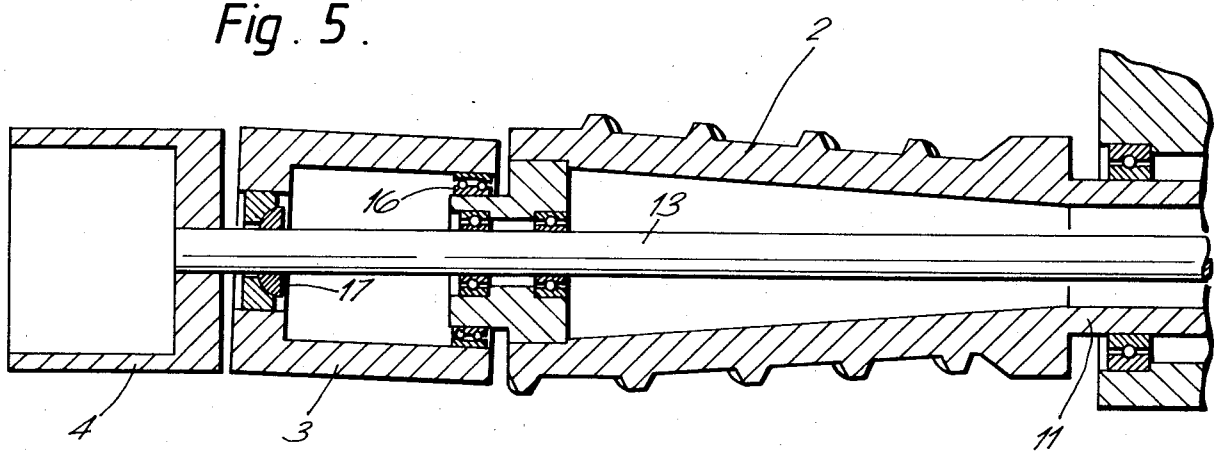
FIG. 5 shows a detail of a third embodiment, whereat the spiral screw rotates the end of the cavity mandrel.

FIG. 5 shows an embodiment in which the initial end of the mandrel 3 is attached to the final end of the spiral 2 eccentrically by means of the bearing 16. The final end of the mandrel is attached to the shaft 13 by means of a ball joint 17. As the screw 2 revolves, its movement of rotation is transferred and converted to a movement of the mandrel mounted to the end of the screw so that the initial end of the centre axis of the mandrel again circulates around the centre axis of the screw.

Figure 6:
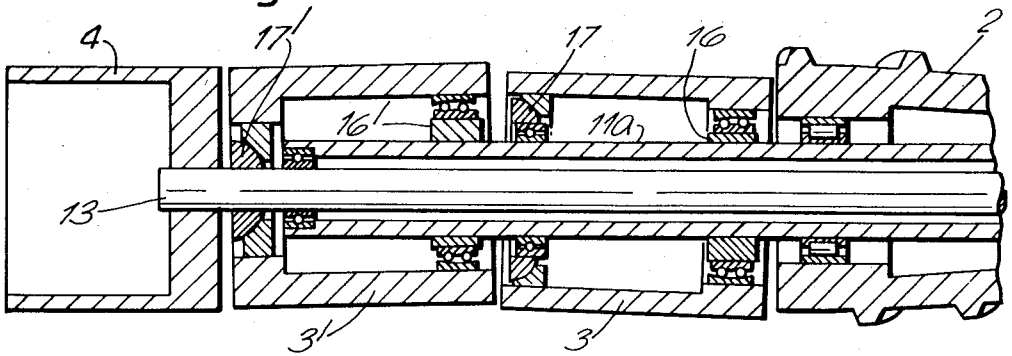
FIG. 6 shows a detail of an embodiment in which the cavity mandrel consists of two parts placed one after the other.

In the embodiment in accordance with FIG. 6, two cavity mandrels 3 and 3' are used, which are fitted one after the other and which are, at their final ends, attached to the shafts 13 and 11*a* by means of ball joints 17 and 17'. The initial ends of the mandrels are attached to the shaft 11*a* eccentrically by means of bearings 16 and 16'. The path of movement of the mandrel 3 closer to the initial end is somewhat wider than that of the mandrel 3' closer to the final end. Moreover, the radius of the ball face of the ball joint 17 closer to the initial end is larger than the radius of the ball joint 17', whereat the centre point of the swinging movement is outside the mandrel.

The movement of the initial end of the mandrel 3 may also be produced by means of various mechanisms of path of movement in themselves known. When the mandrel 3 does not revolve, its end next to the follower tube may also have a cross-section different from a circular cavity. In such a case, the end next to the screw may be circular or slightly shaped so as to correspond to the cavity.

FIG. 7 shows how different cavity forms can be obtained by using different paths of mandrel movement. The path of movement may be, e.g. square or triangular. The may also be horizontal or vertical movement, occurring reciprocally along a straight line.

The mandrel may be either cylindrical or conical, in which case circular cavities are obtained. When a mandrel is used whose section is not circular, a cross-section of a cavity shaped in a corresponding way is obtained.

Figure 8A:
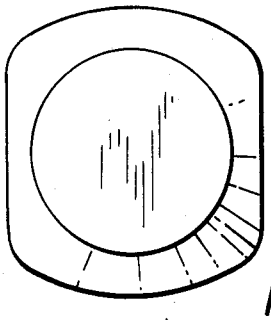
FIGS. 8*a* to 8*c* show an example on the shaping of the mandrel.
Figure 8B:
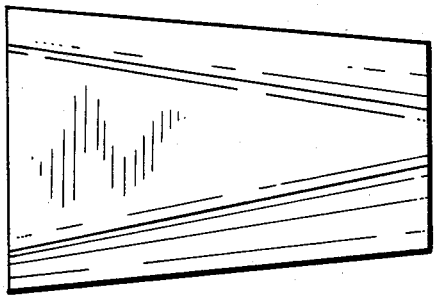
Figure 8C:
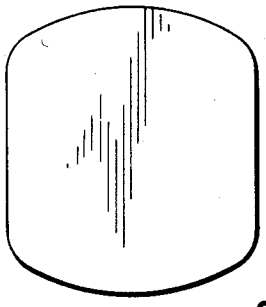

FIGS. 8*a* to 8*c* show an example on the shaping of the mandrel. FIG. 8*a* shows a circular section of the initial end of the mandrel. FIG. 8*b* is a side view of the mandrel. FIG. 8*c* is a sectional view of the final end of the mandrel.

It is also possible to place the ball joint so that the final end of the cavity mandrel moves while the initial end also moves, or that only the final end of the mandrel moves.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the accompanying claims.

I claim:

1. A method for casting hollow slabs out of concrete, in which concrete mix is extruded onto a base of a casting apparatus by means including at least one forming member for forming cavities in the slabs and the mix is compacted by moving said at least one forming member, wherein at least one end of said at least one forming member is moved along a predetermined path so that one point along a longitudinal axis of said at least one forming member maintains its position throughout movement of the member with respect to said longitudinal axis while another point longitudinally displaced along said longitudinal axis radially changes its position with respect to said longitudinal axis during movement of the forming member.

2. The method of claim 1, wherein a rear end of said longitudinal axis of said at least one forming member maintains its position with respect to said casting apparatus.

3. The method of claim 1, wherein concrete mix is extruded onto the base by means of a revolving screw spiral fitted in front of said at least one forming member, wherein at least one end of said at least one forming member is moved along a path that passes around the axis of the screw spiral.

4. The method of claim 1, wherein said at least one end of said at least one forming member is moved along a substantially circular path.

5. The method of claim 3, wherein rotary movement of said at least one end of the at least one forming member is produced by means of an eccentric attached to the revolving screw conveyor fitted in front of the forming member.

6. The method of claim 1, wherein said at least one forming member is additionally rotated around its longitudinal axis.

7. The method of claim 2, wherein concrete mix is extruded onto the base by means of a revolving screw spiral fitted in front of said at least one forming member, wherein at least one end of said at least one forming member is moved along a path that passes around the axis of the screw spiral.

8. The method of claim 2, wherein said at least one end of the at least one forming member is moved along a substantially circular path.

9. The method of claim 2, wherein rotary movement of said at least one end of the at least one forming member is produced by means of an eccentric attached to a revolving screw conveyor fitted in front of the forming member.

* * * * *